US007290658B2

(12) United States Patent
Slattery et al.

(10) Patent No.: US 7,290,658 B2
(45) Date of Patent: Nov. 6, 2007

(54) CHARGER WIRE PACKAGE AND CONTAINER

(75) Inventors: Scott T. Slattery, Brockport, NY (US); Carol K. Dunn, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 376 days.

(21) Appl. No.: 10/903,046

(22) Filed: Jul. 30, 2004

(65) Prior Publication Data

US 2006/0021892 A1 Feb. 2, 2006

(51) Int. Cl.
*B65D 85/00* (2006.01)

(52) U.S. Cl. ..... 206/388; 206/525.1; 229/87.02; 229/87.05

(58) Field of Classification Search ..... 206/63.3, 206/372, 380, 388, 425, 523, 525.1, 526; 299/87.02, 87.03, 87.05; 399/171, 173
See application file for complete search history.

(56) References Cited

U.S. PATENT DOCUMENTS

| | | | | |
|---|---|---|---|---|
| 4,089,410 | A * | 5/1978 | Bolanowski et al. | 206/63.3 |
| 4,391,365 | A * | 7/1983 | Batchelor | 206/63.3 |
| 4,418,821 | A * | 12/1983 | Sandel | 206/63.3 |
| 2002/0074250 | A1* | 6/2002 | Huang | 206/425 |
| 2002/0179475 | A1* | 12/2002 | Kohana | 206/425 |

* cited by examiner

*Primary Examiner*—Luan K Bui
(74) *Attorney, Agent, or Firm*—Donna P. Suchy

(57) ABSTRACT

A package (30) for an individual charging wire (10) includes a backing (32) having a back portion (42) and a front portion (44). A first perforation (46) is defined in the backing (32) between the back portion (42) and the front portion (44). A closing strip (36) is disposed on the back portion (42). A padding strip (34) is disposed on the back portion (42) between the closing strip (36) and the first perforation (46). A second perforation (48) is defined in the back portion (42) between the closing strip (36) and the padding strip (34).

6 Claims, 11 Drawing Sheets

CHARGER WIRE PACKAGE AND CONTAINER

FIELD OF THE INVENTION

The present invention relates to a package for an individual charger or corona wire of the type used in electrophotographic printing and/or copying machines, to a container for a plurality of such individual charger wire packages, and a method of individually packaging such wires.

BACKGROUND OF THE INVENTION

Electrophotographic printing and/or copying machines use thin wires, referred to as charger or corona wires, in order to charge and/or discharge various surfaces and thereby attract/repel toner particles to/from those surfaces. In most electrophotographic machines, one such charger wire typically extends in close proximity and parallel to the surface of the photoconductive drum and is used to charge that surface. Another charging wire is typically positioned to charge the image-receiving substrate (typically a sheet of paper) as it travels toward the drum. Other charging wires may be positioned and used elsewhere within electrophotographic machines, such as, for example, to charge and/or discharge the drum and/or other components of the machine.

As shown in FIG. 1, a typical charging wire 10 generally includes a wire portion 12 attached at each end thereof to copper lugs or terminals 14 that are typically pressed-on to wire portion 12. Wire portion 12 is typically very thin, such as, for example, 0.022 to 0.004 inches in diameter. The thin wire portions 12 are relatively fragile and sensitive to vibration. Therefore, the charging wires and the container within which they are packaged must be handled with great care.

Multiple charging wires are typically packaged within a single container for shipping and/or handling. A typical such packaging arrangement is illustrated in FIG. 2, wherein a plurality of wires 10 are shown contained within a single container 20. More particularly, opposing terminals 14 are received within respective holders 22, which are typically constructed of molded foam and disposed within container 20 at opposite ends or sides thereof. Wire portions 12 extend between the opposing terminals 14 and holders 22, and are thus maintained in a taught condition or under a predetermined/desired tension.

Due to their fragility, a significant proportion of wires are often broken during shipping and handling, and additional wires may be broken as they are unpacked and exposed to further handling.

Therefore, what is needed in the art is an improved container and method of packing a plurality of charging wires for shipping and handling.

Furthermore, what is needed in the art is a package for individual charging wires that protects single charging wires from damage during shipping and handling in a bulk container, and during unpacking and subsequent handling of the individual wires.

SUMMARY OF THE INVENTION

The present invention provides a package for an individual charging wire, a method for packaging an individual charging wire, and a container for a plurality of individually-packaged charging wires.

The invention comprises, in one form thereof, a package for an individual charging wire that includes a backing having a back portion and a front portion. A first perforation is defined in the backing between the back portion and the front portion. A closing strip is disposed on the back portion. A padding strip is disposed on the back portion between the closing strip and the first perforation. A second perforation is defined in the back portion between the closing strip and the padding strip.

An advantage of the present invention is that the individually-packaged charge wires are less susceptible to damage caused by shipping and handling.

A further advantage of the present invention is that the individually-packaged charge wires are placed in a container and are less susceptible to damage caused by shipping and handling.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
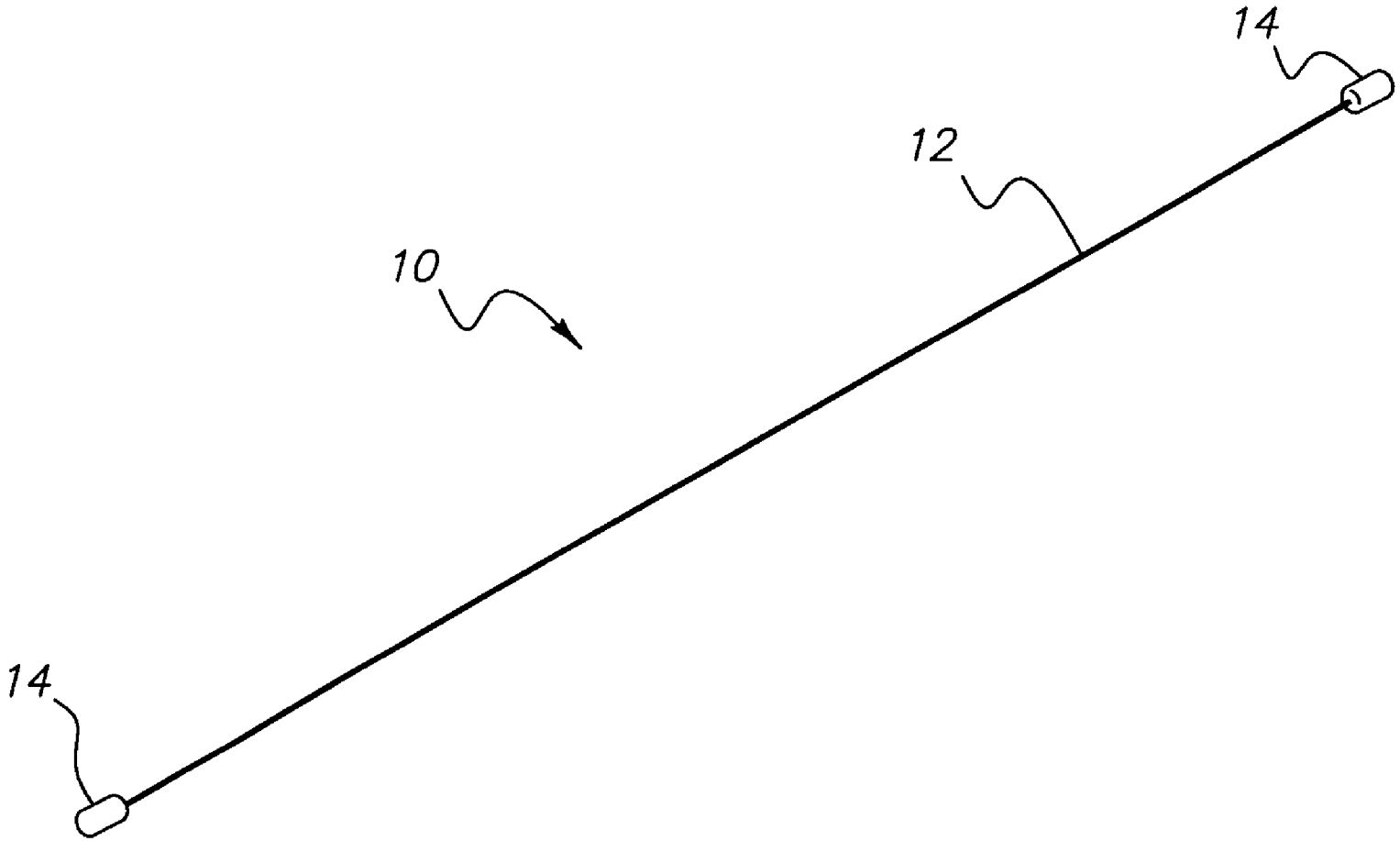
FIG. 1 is a perspective view of a single charging wire.
Figure 2:
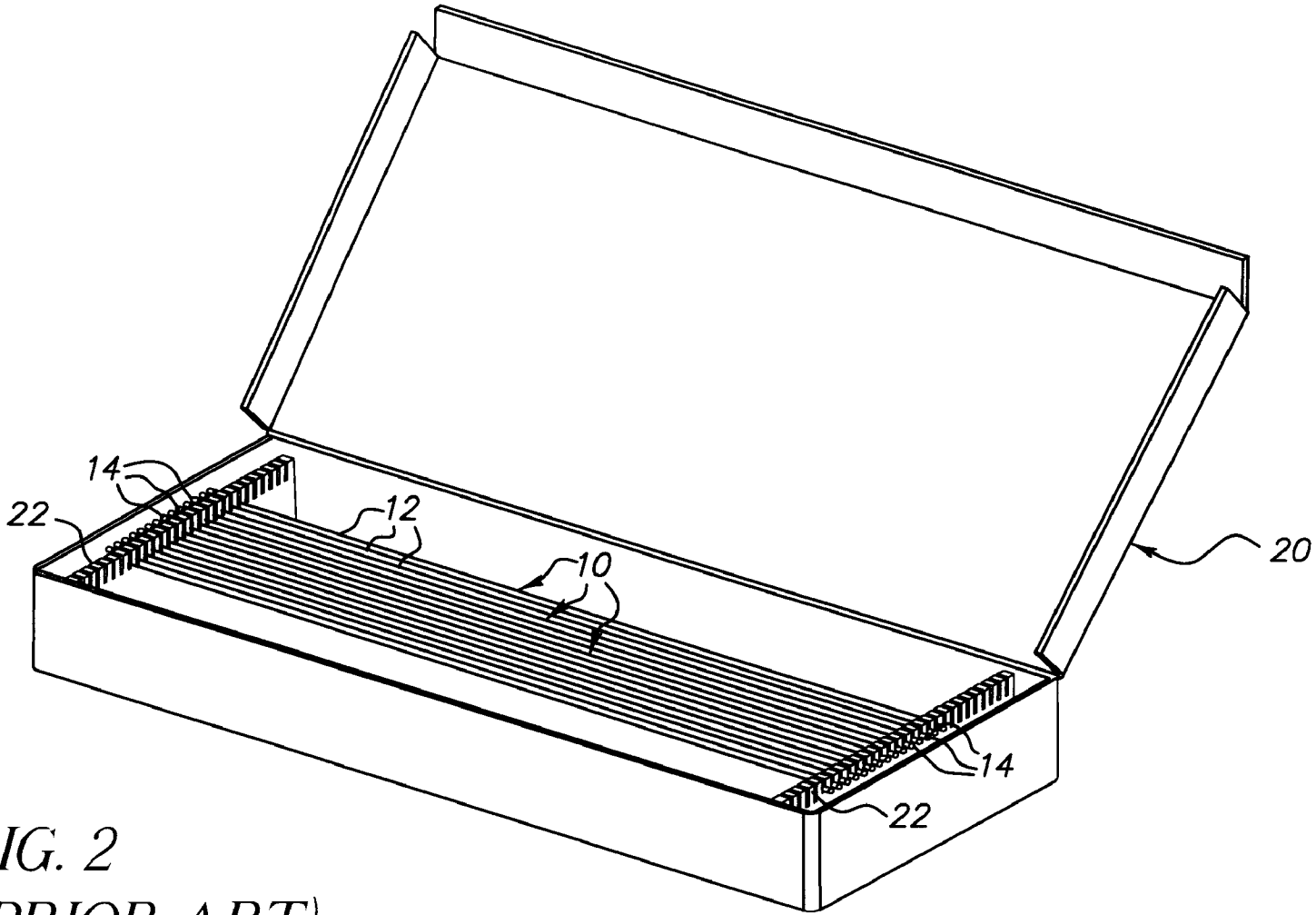
FIG. 2 (PRIOR ART)
FIG. 2 is a perspective view of a conventional container for a plurality of single charging wires.
Figure 3:
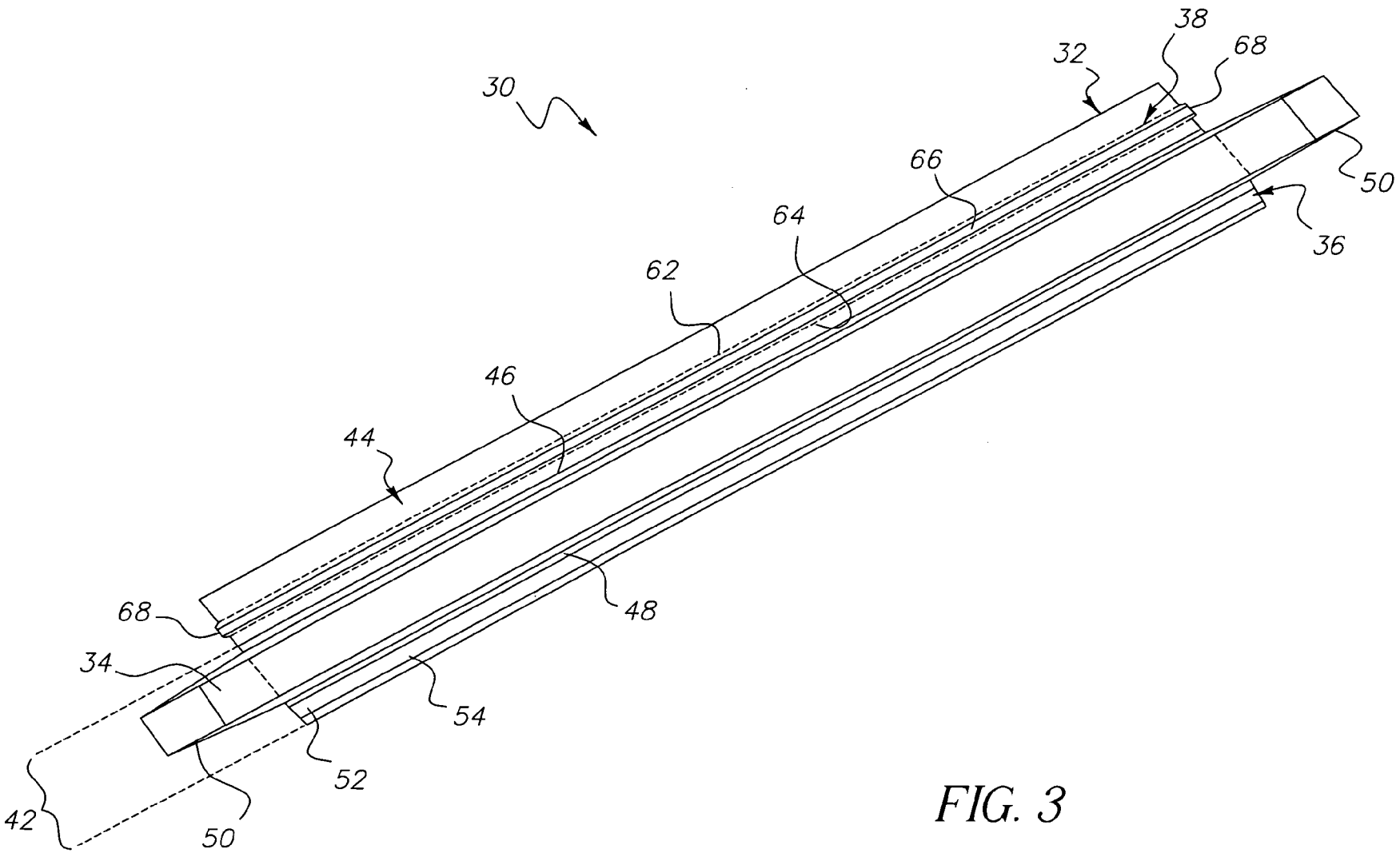
FIG. 3 is a perspective view of one embodiment of a package for a single charging wire of the present invention.

Referring now to FIG. 3, a perspective view of one embodiment of a package for an individual charging wire is shown. Individual charging wire package 30 includes backing 32, padding 34, closing strip 36, and tear strip 38. Generally, individual charging wire package 30 receives and is formed around an individual charging wire 10 and protects charging wire 10 from damage during packaging, shipping and handling.

More particularly, backing 32 includes a first or back portion 42, a second or front portion 44, first perforation 46, second perforation 48, and wing portions 50. Backing 32 is preferably constructed of a relatively heavy-weight paper or plastic sheet-like material, although other suitable materials can be used. Padding 34 is affixed, such as, for example, by adhesive, to first/back portion 42. Padding 34 is configured, for example, as open-cell foam and is preferably adhesive-backed open-cell foam. First perforation 46 is defined by backing 32 and is disposed between first/back portion 42 and second/front portion 44. Second perforation 48 is defined by backing 32 within first/back portion 42 and is disposed between padding 34 and closing strip 36.

Closing strip 36 includes a layer or stripe of adhesive 52 that is affixed to or deposited upon first/back portion 42 and is disposed between padding 34 and the outer edge (not referenced) of first/back portion 42. Closing strip 36 also includes release paper 54, which is disposed over and covers adhesive strip 52. While in place, release paper 54 prevents adhesive strip 52 from undesirably sticking to unintended objects and/or picking up foreign material. Release paper 54 is configured to be easily released or separated from adhesive strip 52, such as, for example, by pulling or peeling.

Tear strip 38 is defined by upper and lower perforations 62 and 64, respectively, each defined by backing 32 and being disposed in second/front portion 44 thereof. Tape strip 66 is a strip of tape that is preferably reinforced with fiber strands (not shown), and which is adhesively affixed to second/front portion 44 of backing 32 between upper and lower perforations 62 and 64 formed therein. Tear strip 38 includes a tab portion 68 that laterally extends from second/front portion 44 of backing 32, the purpose of which is more particularly explained hereinafter.

Figure 4A:
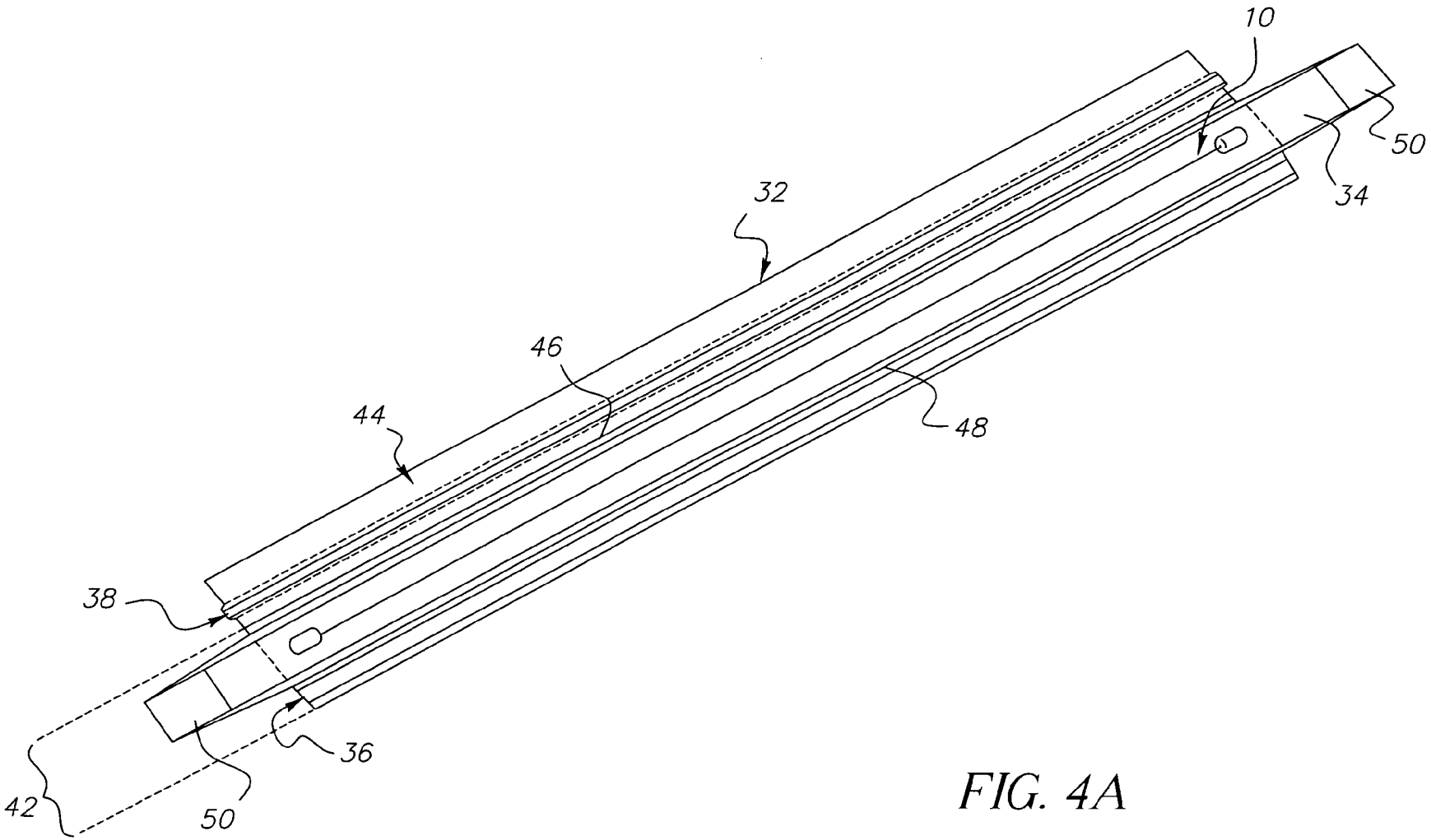
FIGS. 4A-4F are perspective views illustrating the several steps for packaging a charging wire in the package for a single charging wire of FIG. 3.
Figure 4B:
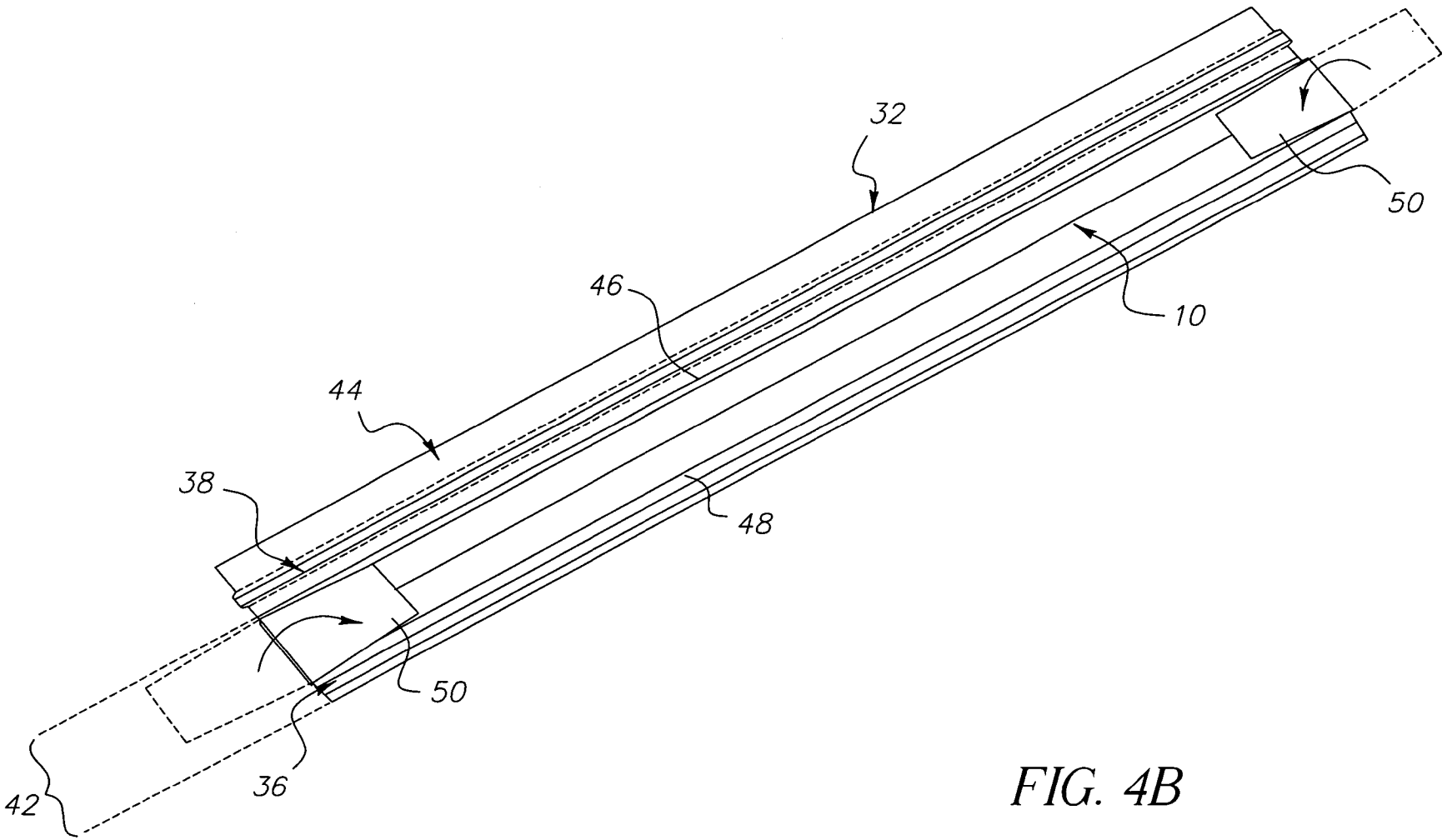
Figure 4C:
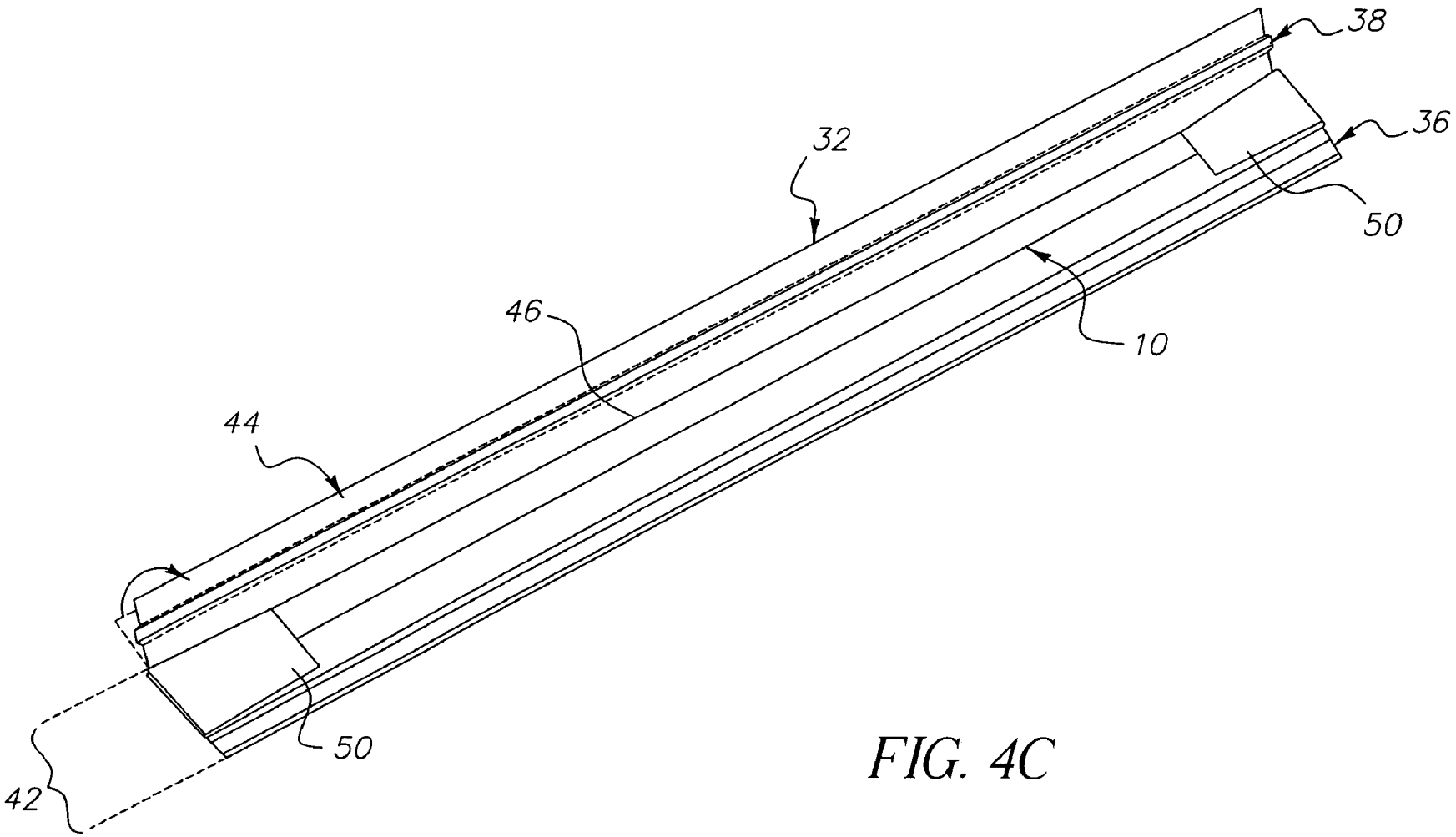
Figure 4D:
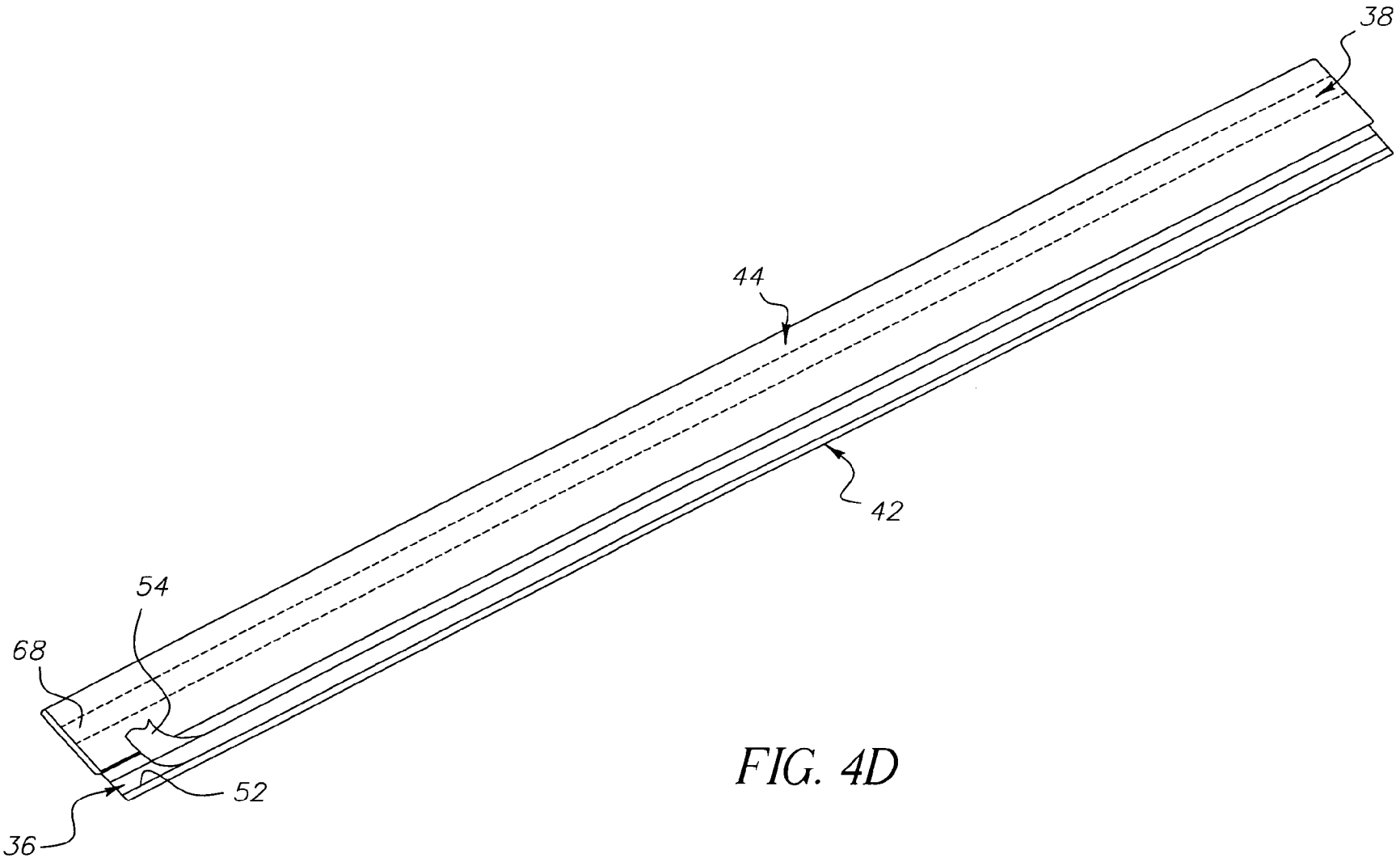
Figure 4E:
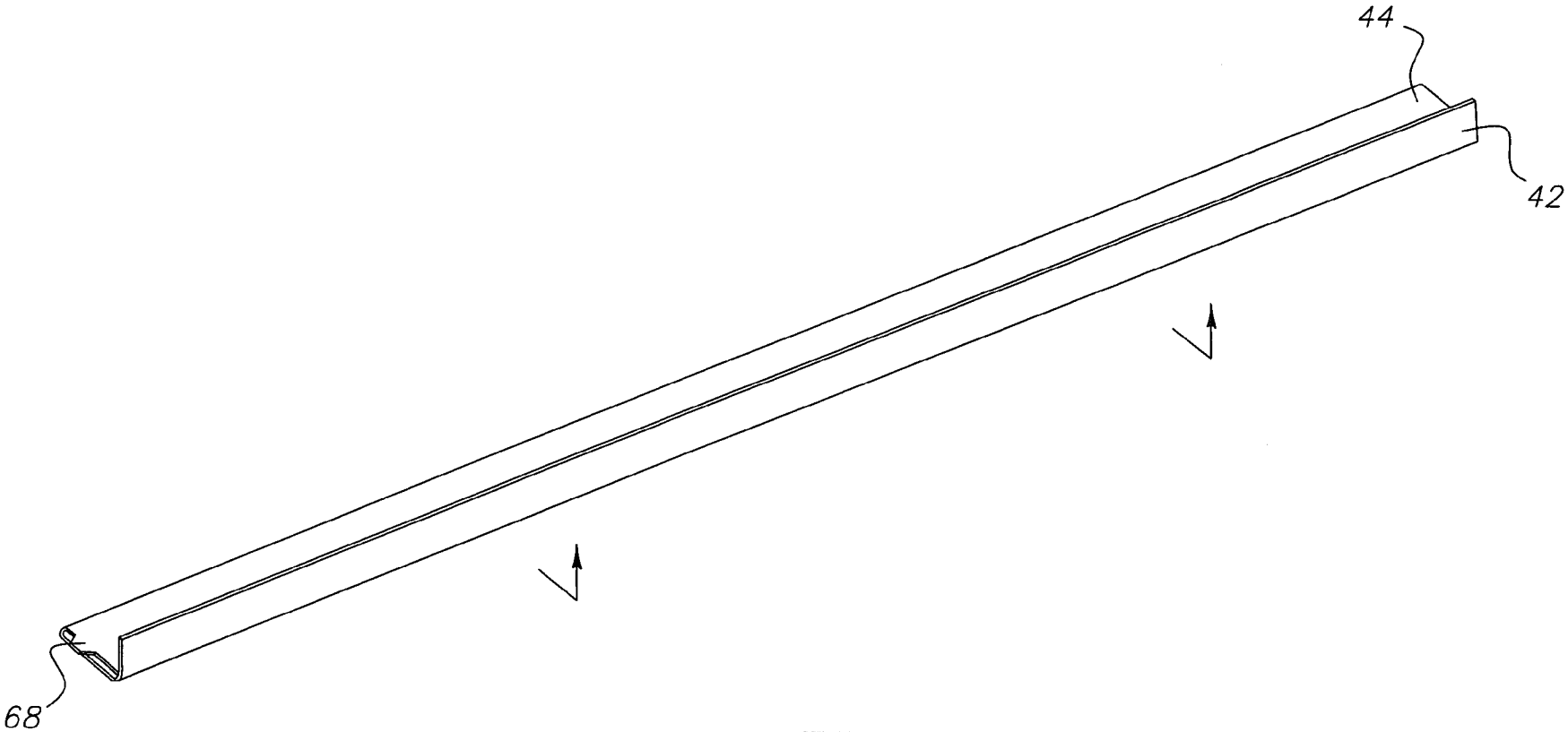
Figure 4F:
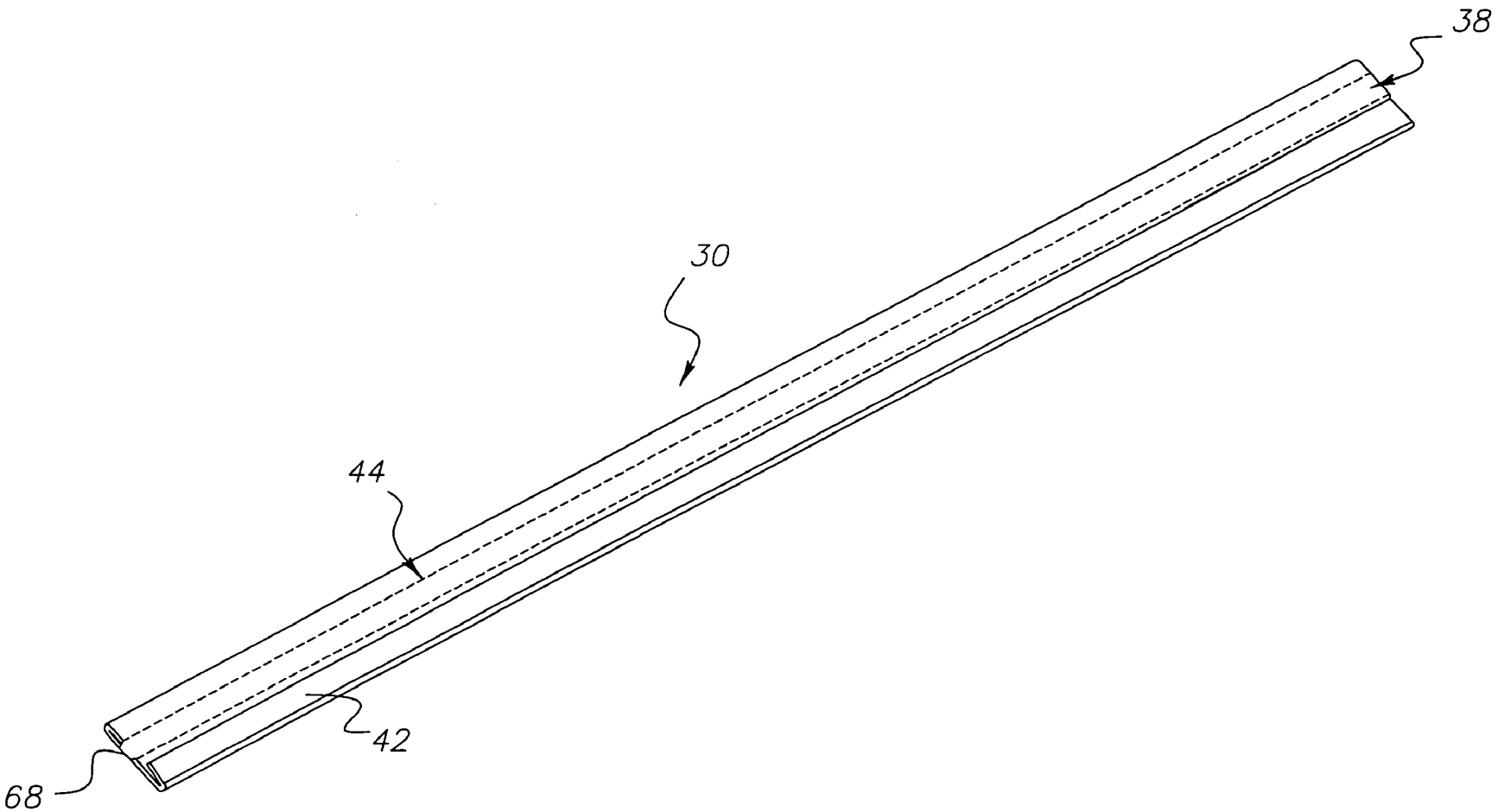

In use, and with reference to FIGS. 4A-4F, the several steps for packaging an individual corona or charging wire in the package of FIG. 3 are illustrated. First, as shown in FIG. 4A, a charging wire 10 is placed onto padding 34 such that terminals 14 thereof are each disposed proximate respective and corresponding wing portions 50 of backing 32. Wing portions 50 are, as shown in FIG. 4B, folded inward and over terminals 14 of charging wire 10. Thereafter, and as shown in FIG. 4C, second/front portion 44 of backing 32 is at first perforation 46 folded inward toward padding 34 over wing portions 50 and wire portion 12 of charging wire 10. At this point, it is preferable to remove release paper 54 from adhesive strip 52, as shown in FIG. 4D. As shown in FIG. 4E, first/back portion 42 is at second perforation 48 folded inward and over second/front portion 44 until adhesive strip 52 of closing strip 36 engages second/front portion 44 thereby affixing first/back portion 42 and second/front portion 44 together. A closed individual charging wire package 30 is thus formed for an individual charger wire 10, and as shown in FIG. 4F.

Figure 5:
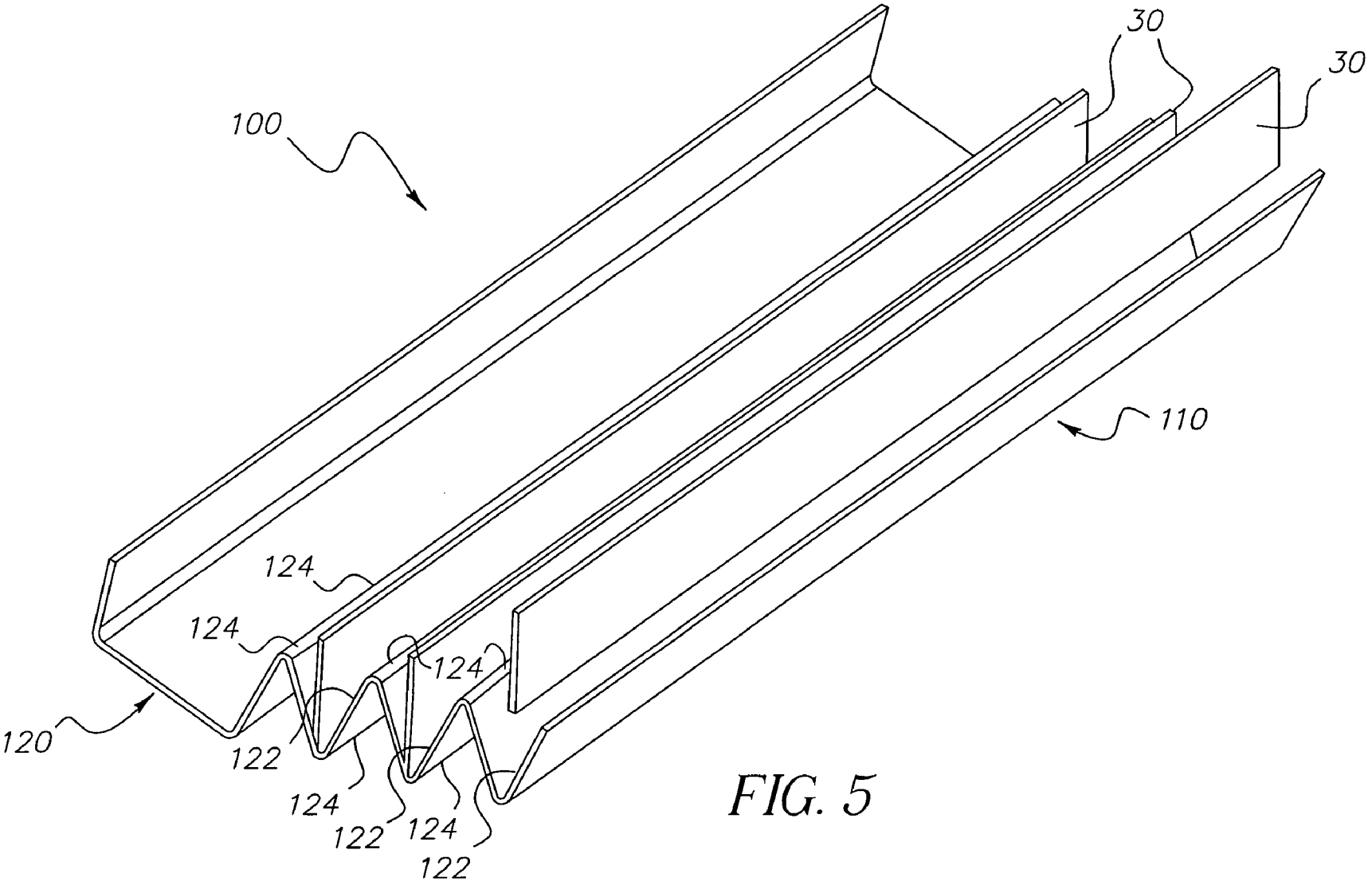
FIG. 5 is a perspective view of one embodiment of a container for a plurality of individually-packaged charging wires of FIG. 4F, in an expanded condition.

Referring now to FIG. 5, one embodiment of a container for a plurality of individually-packaged charging wires is shown. Container 100 includes a folding portion 110 and a flap portion 120. Generally, a plurality of individual charging wire packages 30, each containing a charging wire 10, are received within container 100.

Figure 6:
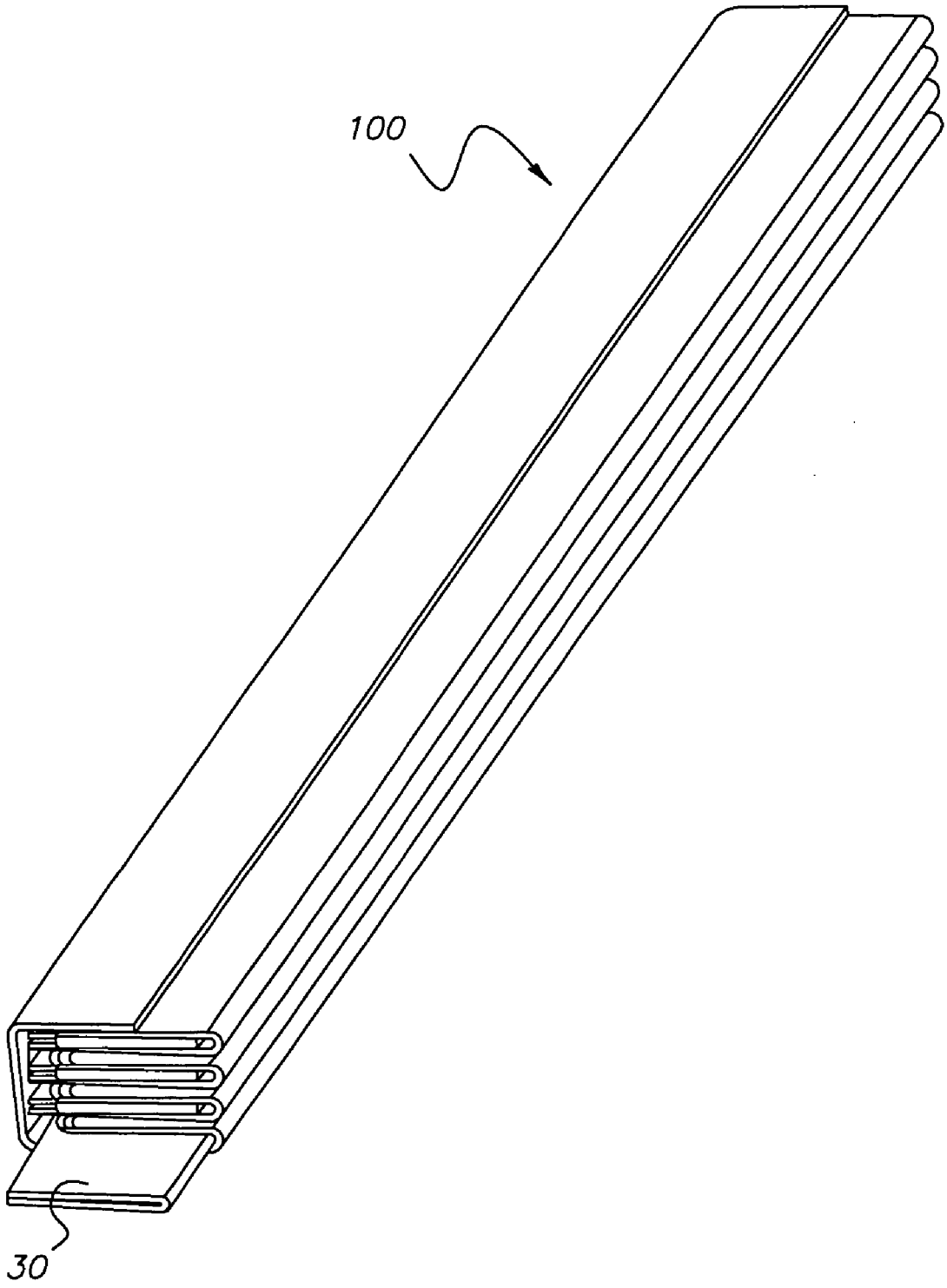
FIG. 6 is a perspective view of the container of FIG. 5 in a collapsed condition.

Folding portion 110 includes a plurality of pockets 122 that are formed when folding regions 124 are folded. Each of pockets 122 are configured and are of appropriate dimensions to receive an individual charging wire package 30. In use, folding portion 110 is partially folded along folding regions 124. Individual charging wire packages 30 are inserted into pockets 122, and container 100 is the further folded and collapsed along folding regions 124 to thereby position pockets 122 in relatively close proximity to each other and, thus, into a relatively compact size. Flap portion 120 is then folded over and/or onto collapsed folding portion 110 and affixed thereto, such as, for example, by tape. The completed and folded/collapsed container 100 is shown in FIG. 6.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

PARTS LIST

10. Charging Wire
12. Wire Portion
14. Terminals
20. Container
22. Holders
30. Individual Package
32. Backing
34. Padding
36. Closing Strip
38. Tear Strip
42. First/Back portion
44. Second/Front portion
46. First Perforation
48. Second Perforation
50. Wings
52. Adhesive
54. Release Paper
66. Table Strip
100. Container
110. Folding Portion
120. Flap portion
122. Pockets
124. Folding Regions

What is claimed is:

1. A container assembly for a plurality of charging wires, comprising:

plurality of respective charging wire packages, each said package including a backing having a back portion and a front portion, a first perforation defined in said backing between said back portion and said front portion, a closing strip disposed on said back portion, a padding strip disposed on said back portion between said closing strip and said first perforation, and a second perforation defined in said back portion between said closing strip and said padding strip; and container including a folding portion and a flap portion, said folding portion defining a plurality of individual pockets each pocket for receiving one of said individually-packaged charging wires, a folding region disposed between each adjacent pair of individual pockets, said folding regions enabling the expansion and collapsing of the container, a flap configured for covering said individual pockets when the container is collapsed.

2. The package of claim 1, further comprising a tear strip disposed on said front portion.

3. The package of claim 2, wherein said tear strip comprises upper and lower substantially parallel perforations defined in said front portion.

4. The package of claim 3, wherein said tear strip further comprises a fiber-reinforced tape affixed to said front portion between said first and second perforations.

5. The package of claim 3, wherein said tear strip further includes a tab portion extending laterally from said front portion.

6. The package of claim 1, wherein said closing strip comprises an adhesive layer disposed on said back portion, a release paper disposed over and covering said adhesive layer.

* * * * *